United States Patent [19]

Harris

[11] 4,247,378

[45] Jan. 27, 1981

[54] ELECTROBRIGHTENING OF ALUMINIUM AND ALUMINIUM-BASE ALLOYS

[75] Inventor: Peter G. Harris, High Wycombe, England

[73] Assignee: The British Aluminum Company Limited, England

[21] Appl. No.: 73,586

[22] Filed: Sep. 7, 1979

[51] Int. Cl.[3] ..... C25F 3/16; C25F 3/20

[52] U.S. Cl. ..... 204/129.95

[58] Field of Search ..... 204/129.85, 129.95

[56] References Cited

U.S. PATENT DOCUMENTS

| | | | |
|---|---|---|---|
| 2,096,309 | 10/1937 | Pullen | 204/129.95 |
| 2,339,806 | 1/1944 | Pullen | 204/129.95 |

FOREIGN PATENT DOCUMENTS

| | | | |
|---|---|---|---|
| 449162 | 6/1936 | United Kingdom | 204/129.95 |
| 513530 | 10/1939 | United Kingdom | 204/129.95 |
| 521290 | 5/1940 | United Kingdom . | |
| 624483 | 6/1949 | United Kingdom | 204/129.95 |
| 655514 | 7/1951 | United Kingdom . | |
| 658699 | 10/1951 | United Kingdom . | |
| 1070644 | 6/1967 | United Kingdom . | |

OTHER PUBLICATIONS

Metal Finishing Guidebook Directory, 36th Edition, 1968, pp. 479–503.

*Primary Examiner*—T. M. Tufariello
*Attorney, Agent, or Firm*—Karl W. Flocks

[57] ABSTRACT

A direct current electrobrightening process for aluminium and aluminium base alloy components capable of producing specular reflectivity values in excess of 80% in alloys down to 99.5% purity by maintaining the electrolyte with a pH of 9 to 10.7, as at a temperature of 70° C., and dispersing local products of reaction and depleted solution from the components at a rate that enables the current density to increase automatically by a factor of 2 to 4.

15 Claims, No Drawings

ELECTROBRIGHTENING OF ALUMINIUM AND ALUMINIUM-BASE ALLOYS

BACKGROUND OF THE INVENTION

This invention relates to the direct current electrobrightening of aluminium and aluminium-base alloys in alkaline electrolytes.

In our British Pat. Nos. 449162 and 513530 there is described a process for electrobrightening aluminium which has become widely known commercially by the Registered Trade Mark "Brytal" and employing an electrolyte including an aqueous solution of $Na_2CO_3$ and $Na_3PO_4$ with certain optional additives, such electrolyte having a pH of at least 10 and a preferred operating temperature of 75°-85° C. It is stated therein that with this process the specular reflectivity of commercially pure sheet can be "raised perhaps to 80%". More specifically, the specular reflectivity values measured subsequently by the co-applicant, Pullen, and his co-workers, on metal of 99.7% and 99.5% purity, were 79% and 72% respectively. These values for specular reflectivity, together with those given by Pullen and Scott (Trans. inst. of Met. Finishing 1956, vol 33, pp. 163-176) were all obtained with the Guild Photometer in which the semi-angle subtended by the diaphragm aperture employed is 14½°, thereby introducing a significant component of diffuse reflectivity into the measurements and so giving artificially high results.

To overcome this defect, a Modified Gloss Head, employing a diaphragm aperture subtending a semi-angle of about 1° was developed by Scott and this has been adopted as a standard method for specular reflectivity measurements in British Standard 1616: 1972, where it is described in Appendix Q. Data given by Scott and Bigford (A.D.A. Conference on Anodising, Nottingham, 1961, Session 11 paper 4) illustrate the effect of replectometer acceptance angle on measured specular reflectivity; thus, in a typical case, a surface with a specular reflectivity of only 63% when measured with the Modified Gloss Head, accepting a semi angle of 1°, showed a value well in excess of 80% when measured with a 14½° semi angle of acceptance. All references hereinafter to specular reflectivity will relate to the more accurate measurements made in accordance with the aforementioned British Standard specification.

It is well established as the result of many years of commercial operation that the Brytal process gives excellent results on metal of 99.99% purity and on certain alloys made therefrom, the specular reflectivity values obtained reaching or even exceeding 85%. However, with decreasing metal purity the specular reflectivity falls off rapidly, being at best about 75% for 99.8% and 60% for 99.5% base metal purity. In recent years general commercial practice has been to make additions of NaOH to the Brytal bath, thereby raising the pH above the original preferred value of about 11.5 (as measured in the hot solution by glass electrode) increasing current density thereby and gaining in speed of treatment, but without any beneficial effect on brightness.

Because of the mediocre results obtained with metal of base purity less than 99.99% many producers of bright anodised aluminium components have preferred to use chemical brightening processes involving dipping the component in a hot acid bath, typically comprising a mixture of phosphoric and nitric acids, without application of electric current. With one such process, specular reflectivity values of at least 80% (ie an increase of up to 30% over the "Brytal" process) are obtainable even on metal of only 99.5% base purity. Processes of this type are however unpleasant to operate, and there has been a recognised need for many years for an environmentally satisfactory chemical or electrochemical brightening process that could deal effectively with metal of less than 99.99% base purity.

Other types of alkaline electrolyte have been proposed for use in electropolishing aluminium, for example (a) caustic alkali with an aluminium complexing agent, such as sodium gluconate as disclosed in British Pat. No. 1,070,644, (b) alkali metal cyanide alone or with an alkali metal thiocyanate as disclosed in British Pat. No. 655,514, (c) alkali metal hydroxide and orthophospate (without carbonate), as disclosed in British Pat. No. 658,699 and (d) electrolytes containing free caustic soda as disclosed in British Pat. Nos. 521,290 and 1,070,644, but only electrolytes of the sodium carbonate-trisodium phosphate (i.e. Brytal) type found widespread commercial application. Many possible additives to Brytal type baths, including ammonia, ammonium salts, substituted ammonias, bicarbonates and acid phosphates, were mentioned in the original patents or have since been tried over the years, but although in some instances improvements in specular reflecticity may have been obtained the results on low purity alloys have never matched the high quality of surface finish obtainable on the same alloys treated by the chemical brighteners of phosphoric acid - nitric acid type.

In reconsidering the "Brytal" process of our previous early British Pats. 449,162 and 513,530 and the many variations which have been made to it throughout the world during over forty years of commercial usage we have taken into consideration the changes in standards of pH measurement over the same period.

Using the most accurate techniques now available the pH of solutions of two grades, pure and technical, of both sodium carbonate and tri-sodium orthophosphate and the four possible "Brytal" electrolytes made up from these was measured at temperatures of 20°-90° C. Full results are given in Table 1.

TABLE 1 pH of Carbonate and phosphate solutions and original type Brytal electrolytes

| Solution of Chemicals | Conc. g/l | pH 20° | 40° | 60° | 70° | 80° | 90° |
|---|---|---|---|---|---|---|---|
| $Na_2CO_3$ (analytical grade) | 150 | 11.9 | 11.5 | 11.2 | 11.1 | 10.9 | 10.85 |
| $Na_2CO_3$ (technical grade) | 150 | 10.95 | 10.75 | 10.6 | 10.6 | 10.45 | 10.4 |
| $Na_3PO_4$. $12H_2O$, pure | 50 $Na_3PO_4$ | 12.85 | 12.25 | 11.8 | 11.7 | 11.45 | 11.25 |
| $Na_3PO_4$Dried, Technical grade | 50 $Na_3PO_4$ | 12.45 | 11.95 | 11.65 | 11.53 | 11.30 | 11.20 |
| Brytal Electrolytes | | | | | | | |
| $Na_2CO_3$ (analytical grade) $+Na_3PO_4$. | 150 | 12.9 | 12.3 | 11.9 | 11.7 | 11.4 | 11.35 |
| $12H_2O$ (pure) | 50 | | | | | | |
| $Na_2CO_3$ (technical grade) | 150 | 11.70 | 11.45 | 11.30 | 11.20 | 11.05 | 10.95 |
| $+Na_3PO_4$. | 50 | | | | | | |

TABLE 1-continued

| pH of Carbonate and phosphate solutions and original type Brytal electrolytes | | | | | | | |
|---|---|---|---|---|---|---|---|
| Solution of Chemicals | Conc. g/l | pH 20° | 40° | 60° | 70° | 80° | 90° |
| Dried (Technical grade) $Na_2CO_3$ (analytical grade) | 150 | 12.20 | 11.85 | 11.6 | 11.45 | 11.25 | 11.15 |
| $+Na_3PO_4$. | 50 | | | | | | |
| Dried (Technical grade) $Na_2CO_3$ (technical grade) | 150 | 12.20 | 11.8 | 11.6 | 11.45 | 11.2 | 11.1 |
| $+Na_3PO_4$. $12H_2O$ (pure) | 50 | | | | | | |

At 20° C., pure grades of both carbonate and phosphate give solutions, at Brytal concentration, of substantially higher pH than technical grades, i.e. 0.95 and 0.4 pH units respectively.

The 150 g/l/50 g/l Brytal electrolytes also differ considerably, the all-pure grade electrolyte having a pH 1.2 units higher than the all-technical grade electrolyte, while the two electrolytes made up from one pure and one technical grade component give identical pH values at roughly midway between all-pure and all-technical electrolytes.

At working temperature, of 70°-90° C., pH values of the solutions of simple substances and of electrolytes fall by about 0.5-1.0 units pH while pH differences between pure and technical grades is roughly halved.

It will be noted that none of the electrolytes has a pH less than 11.70 at 20° C. and 10.95 at 90° C.

It is therefore concluded that the pH of the original Brytal electrolyte as measured by our glass electrode procedure at 20° Was in fact in the range 11.7-12.9, while at the working temperature specified, i.e. 75°-85°, it was in the range 11.0-11.6 according to purity of chemicals, pure chemicals giving the higher value.

Thus we believe that had current pH measuring techniques been available at the time of filing the applications resulting in British Pat. Nos. 449,162 and 513,530 references to a pH value as low as 10 would not have been made and we now know that the "Brytal" process as disclosed in these specifications will not work satisfactorily unless the electrolyte is maintained at a higher pH value. This belief is confirmed by L. Laser in Galvanotechnik 1971 62(a) 779-784 where it is stated "The pH value of the electrolyte is about 10.5 to 12." although even here we think the lowest level referred to is misleading.

It is an object of the present invention to provide an alkaline electropolishing process capable of giving good results on both low purity and high purity base metal.

BRIEF SUMMARY OF THE INVENTION

According to one aspect of the present invention there is provided a process for the direct current electrobrightening of a component of aluminium or an aluminium base alloy in which the component constitutes an anode in an electrolyte comprising an aqueous solution containing carbonates and phosphates in which the solution contains at least one member selected from the group consisting of the carbonates, hydrogen carbonates and sesquicarbonates of the alkali metals and ammonia; and at least one member selected from the group consisting of the mono-, di-, and tribasic orthophospates of the alkali metals and ammonia; characterised in that the pH value of the solution measured by glass electrode as at 70° C., is from 9.0 to 10.7; and in which local products of reaction and depleted solutions are continuously dispersed from the surface of the component at a rate that enables the current density automatically to increase by a factor of 2 to 4 over its value in the absence of such continuous dispersion. The working temperature of the solution may be between 80° C. and the boiling point of the solution and is advantageously between 90° C. and said boiling point.

In the electrolyte, the ratio of the total carbonate content, reckoned as $CO_3$, to the total phosphate content, reckoned as $PO_4$, may be between 1 and 8 and preferably between 1.25 and 3. The carbonate concentration is preferably not less than 50 g $CO_3$/l and the phosphate concentration is preferably not less than 20 g $PO_4$/l. In each case the maximum concentration is limited only by solubility considerations at operating temperature. Suitable total contents of phosphate and carbonate are 60-125 g/l $PO_4$ and 170-220 g/l $CO_3$ respectively. A preferred range of pH value is 9.5-10.5; 9.8-10.3 being particularly satisfactory.

The Brightening solution may also contain at least one additional acid radical. This may for example be from the group consisting of nitrate, sulphate, fluoride, borofluoride, tartrate and citrate. Such acid radical may be incorporated in the brightening solution by making additions thereto of the corresponding acids or of the alkali metal or ammonium salts of these acids. The sulphate and flouride may also be added in the form of the acid salts bisulphate and bifluoride, so assisting in obtaining the desired low pH value.

The continuous dispersal of local products of reaction and depleted solution from the surface of the component may be achieved by maintaining the component and the brightening solution in a state of vigorous relative agitation during the passage of current for example by application of one or more of the following procedures:

(a) Pumping jets of electrolyte on to the treated surface of the component.
(b) Vigorously agitating the electrolyte around the component by pneumatic or mechanical means.
(c) Rapidly oscillating or rotating the component.
(d) By operating the electrolyte at such temperature as to induce vigorous local boiling in the neighbourhood of the component or alternatively by adding a small quantity of a volatile substance such as an alcohol.
(e) Vibration of the component by mechanical or electrical means. With a view to promoting uniform polishing the article may be exposed to acoustic or altrasonic vibration whilst in the electrolyte.

DETAILED DESCRIPTION OF THE INVENTION

In recent studies of the Brytal type process we have used a glass electrode assembly specifically designed for measuring pH values in hot strongly alkaline solutions to make measurements in the hot electrolyte, typically at 70° C. It was not found possible using the ingredients specified in British Pat. No. 449,162 to obtain pH values lower than 11.0-11.5. We then made additions of $NaHCO_3$ to the electrolyte to lower the pH value, and we were able to raise the specular reflectivity of 99.5% purity aluminium from a maximum value of 60% to a maximum value of about 68%. At about 10.8 we encountered objectionable macro-roughening of the metal surface, on metal of 99.99% purity. At still lower pH values (10.0–10.5), attained by substantial additions of $NaHCO_3$ in the range 50–100 g/l, a bright "frosted", non-specular finish was obtained. On microscopic examination of the frosted surface it was found that the surface was in fact polished on a microscale but was composed of numerous small areas from which different amounts of metal had been removed. This phenomenon was believed to be due to local stopping-off effects attributable to non-uniform solid films or viscous layers. The effect of gentle agitation of the electrolyte, in addition to the normal gentle oscillation of the specimen in the electrolyte, was tried, but little if any benefit was obtained. However, on vigorous agitation of the specimen and electrolyte in relation to each other, so as thoroughly to scour the metal surface, a brilliant specular finish over the whole surface developed, the current density being increased by a factor of 2–4. When aluminium of 99.5% purity was electrobrightened in the electrolyte of pH 10.0–10.5 using violent agitation, excellent specular reflectivity values of about 85% were obtained. This figure is to be compared with a maximum value of about 60% using the conventional Brytal process under good conditions and up to 85% by chemical brightening with phosphoric-nitric acid mixture.

In the electrolyte, the ratio of the total carbonate content, reckoned as $CO_3$, to the total phosphate content, reckoned as $PO_4$, may be between 1 and 8 and preferably between 1.25 and 3. The carbonate concentration is preferably not less than 50 g $CO_3$/l and phosphate concentration is preferably not less than 20 g $PO_4$/l. In each case the maximum concentration is limited only by solubility considerations at operating temperature. Suitable total content of $PO_4$ and $CO_3$ are 60–125 and 170–220 g/l respectively. A preferred range of pH value is 9.5–10.5; 9.8–10.3 is particularly satisfactory.

When preparing the electrolyte it is not possible to use mixtures of alkali metal carbonate and tri-orthophosphate only; a convenient way of reaching the desired low pH level is to introduce some proportion of more acidic salts, such as mono- or di-hydrogen phosphates, hydrogen carbonates, or sesquicarbonates. The bath so prepared will thus comprise an aqueous solution containing the anions $HCO_3^-$, $HPO_4^{--}$, $H_2PO_4^-$, $CO_3^{--}$, $PO_4^{---}$ and $OH^-$, and at least one cation selected from the group consisting of the cations $Na^+$, $K^+$ and $NH_4^+$.

The aluminium content of a new electrolyte will rise naturally as a result of use, but the equilibrium level is so low that there is no need to make additions of $Al(OH)_3$ or aluminium metal to the bath in order to establish an equilibrium concentration of aluminium ions prior to starting operation of the bath.

It is sometimes desirable to be able to obtain the desired low pH level without adding to the cations present and this can be done by passing $CO_2$ or $SO_2$ through the bath until the desired pH value is obtained. It is possible to make additions of certain acids for this purpose, for example the mineral acids $HNO_3$, $H_3PO_4$, HF,$HBF_4$ and the organic acids citric, salicyclic, tartaric and benzoic. It is believed that almost any of the stronger organic acids including acetic and oxalic can be used for this purpose, though the use of these latter is not specifically recommended. As a corollary, nitrates, sulphates, fluorides, borofluorides, tartrates, citrates and salts of many other organic acids may be present in the bath and can sometimes be added with advantage. In general it is preferred to lower the pH value of the bath to the desired level by making additions of acid salts as previously described, thus avoiding the loss of $CO_2$ associated with the use of acids for this purpose.

Thus the acid radicals may be incorporated in the brightening solution by making additions thereto of the corresponding acids or of the alkali metal or ammonium salts of these acids. The sulphate and fluoride may also be added in the form of the acid salts bisulphate and bifluoride, so assisting in obtaining the desired low pH value.

Known aluminium sequestrants, surfactants and dispersing agents may be added to the bath.

Other constituents known to be incorporated in alkaline electrobrightening baths can generally be tolerated in the bath of the present invention or sometimes added with advantage thereto. Examples of such constituents are hydroxylamine, ethanolamines and ammonium salts.

The operating temperature of the bath may be from about 80° C. to the boiling point of the electrolyte, which can be at least as high as 105° C. Preferably the temperature is at least 90°.

The electrolyte may be contained in a tank made of mild or stainless or other material capable of withstanding the mildly alkaline electrolyte at the working temperature. If of electrically conducting material, the tank may be made the cathode of the electrolytic treatment cell.

A range of about 2–25 volts DC may be used in carrying out the process, 10–15 volts being preferred.

The desired vigorous relative agitation between the electrolyte and the article to be brightened may be achieved in a number of ways, for example by application of one or more of the following procedures:

(a) Pumping jets of electrolyte on to the treated surface of the component.
(b) Violently agitating the electrolyte around the component by pneumatic or mechanical means.
(c) Rapidly oscillating or rotating the component.
(d) By operating the electrolyte at such temperature as to induce vigorous local boiling in the neighbourhood of the component.
(e) Vibration of the component by mechanical or electrical means. With a view to promoting uniform polishing, the articles may be exposed to acoustic or altrasonic vibration whilst in the electrolyte.

We have made further attempts to produce electrobrightening with the pH of the brightening solution at or a little below 10.8 and we found that under these conditions even metal of 99.99% purity develops a macro-roughened surface which cannot be cured by vigorous relative agitation between the metal and the solution without producing objectionable white streaks. At this pH value microbrightening of low purity metal is very poor. It appears therefore that there exists a narrow band of pH within which satisfactory electrobrightening is not practicable. Above this band, good brightening is possible by the method of the prior art, but only for metal of 99.99% minimum base purity; below this pH band good brightening can be obtained with aluminium or an aluminium alloy having a base purity normally suitable for anodising, by the method of the present invention.

Using the process of the present invention the following specular reflectivity values have been obtained on unalloyed aluminium of specified purity and on certain aluminium alloys of purity conforming with the appropriate specifications, the actual contents of iron, magnesium and copper being included where appropriate.

| Alloy or Purity | Actual content (%) of specified elements | | | | Specular Reflectivity % |
|---|---|---|---|---|---|
| | Cu | Mg | Fe | Others | |
| 99.99% | | | | | 88–90 |
| 99.8% | | 0.01 | 0.06 | | 88 |
| 99.8% (domestic trim) | 0.04 | | 0.06 | | 88 |
| 99.5% | 0.002 | 0.02 | 0.21 | | 86 |
| 5457 | 0.04 | 0.90 | 0.60 | Mn 0.22 | 87 |
| 5252 | 0.05 | 2.5 | 0.07 | | 87 |
| 5005 | 0.004 | 0.98 | 0.29 | | 86 |
| 7016 | 0.80 | 0.96 | 0.08 | Zn 4.4 | 83 |
| BA732 | 0.24 | 1.0 | 0.06 | Zn 4.7 | 85 |
| High-Fe alloy | 0.001 | 0.01 | 1.06 | | at least 80 |

It will, be seen that, with the process of the present invention, specular reflectivities in excess of 80% are attainable over a wide range of composition embracing the various types of aluminium alloy which it may be desired to brighten. Particularly noteworthy are (i) the high specular reflectively values for 99.8% purity and 99.5% purity, which may be compared with the figures 75% and 60% already quoted as being attainable when the conventional 'Brytal' bath under best conditions, and (ii) the ability to achieve values in excess of 80% even in the presence of in excess of 1% iron.

The process of the present invention has a number of advantages over the prior art as represented by the original 'Brytal' bath and its various modifications. Thus:

1. For high quality results there is no longer a restriction to metal of 99.99% minimum base purity.
2. The full range of bright anodising alloys can be brightened to a standard equivalent to, and in some cases exceeding, that obtainable by chemical treatment in nitric acid-phosphoric acid solutions—and without incurring the fume control and acid liquor disposal problems associated with the latter method.
3. Optimum treatment conditions for 99.99% base purity and the full range of bright anodising alloys are similar, so that all these alloys may, if desired, be treated at the same time in the same electrolyte under the same operating conditions.
4. Specular reflectivity is comparatively insensitive to operating temperature over the useful temperature range (i.e. from about 80° C. to the boiling point of the bath).
5. Current densities may extend up to at least 15 A/dm$^2$, and treatment times may be as short as 3 min or as long as 45 min. In consequence the process time of the operation can readily be altered to be incorporated into a bright anodising operation sequence, e.g. in automatic bright anodising plant.
6. Whereas in the conventional alkaline electrobrightening process it is accepted practice to avoid, as far as possible, all electrolyte circulation e.g. by insulating cathodes from the treatment tank, fitting them with baffles to restrict circulation induced by hydrogen evolution, and avoiding bath heating during active operation, the process of the present invention is affected beneficially by electrolyte movement. The electrolyte may therefore be circulated freely, even vigorously, so facilitating heating, filtration and maintenance of uniform conditions. The treatment tank itself may therefore be employed as cathode without fear of the brightening effect being marred by streams of cathode gas.
7. There is no significant "running-in" period when putting a fresh bath of electrolyte into service. With the bath of the present invention the aluminium content rapidly stabilises at a very low value, typically less than 0.4 g/l, and down to 0.049/l which is at least an order of magnitude lower than that for the conventional alkaline electrobrightening Brytal type bath. In consequence the variable brightening response shown by the conventional bath during the period that the aluminum content of the electrolyte is building up to the deposition value is not exhibited by baths in accordance with the present invention. The low concentration of dissolved aluminium in the latter bath moreover greatly eases the problems of removing the sludge by settlement or filtration.
8. As a result of the aluminium dissolved by the electrolyte during brightening being spontaneously reprecipitated to leave the electrolyte virtually aluminium free, the life of the electrolyte may be extended almost indefinitely.
9. By operating the process with a pH value below 11 any precipitations of aluminium compounds in the electrolyte are granular and are easily removed by settling or filtration whereas such precipitates at higher pH values would be gelatinous and difficult to filter out.
10. The viscosity of the electrolyte of the present invention is comparatively low and does not significantly rise in use. At the desired working temperature the viscosity is comparable with that of water at room temperature so that when a component is removed from the electrolyte "drag out" losses are low. By comparison unused solutions of phosphoric and nitric acids used in chemical brightening processes typically have a viscosity four times as great which rises to a much higher value in use so that "drag out" losses can be very high.

I claim:

1. A process for the direct current electrobrightening of a component of aluminium or an aluminium base alloy in which the component constitutes an anode in an electrolyte comprising an aqueous solution containing carbonates and phosphates in which the solution contains at least one member selected from the group consisting of the carbonates, hydrogen carbonates and sesquicarbonates of the alkali metals and ammonia; and at least one member selected from the group consisting of the mono-, di-, and tribasic orthophosphates of the alkali metals and ammonia; characterised in that the pH value of the solution measured by glass electrode as at 70° C., is from 9.0 to 10.7; and in which local products of reaction and depleted solution are continuously dispersed from the surface of the component at a rate that enables the current density automatically to increase by a factor of 2 to 4 over its value in the absence of such continuous dispersion.

2. A process according to claim 1 characterised in that the working temperature of the solution is between 80° C. and the boiling point of the solution.

3. A process according to claim 2 characterised in that the working temperature of the solution is between 90° C. and the boiling point of the solution.

4. A process according to claim 1 characterised in that the ratio of the total carbonate content, reckoned as $CO_3$, to the total phosphate content, reckoned as $PO_4$ is between 1 and 8.

5. A process according to claim 4 characterised in that the ratio is between 1.25 and 3.

6. A process according to claim 1 characterised in that the carbonate concentration is not less than 50 g $CO_3$/l and the phosphate concentration is not less than 20 g $PO_4$/l the maximum concentrations in each case being limited by solubility considerations at operating temperature.

7. A process according to claim 1 characterised in that the total contents of phosphate and carbonate are respectively 60–125 g/l $PO_4$ and 170–220 g/l $CO_3$.

8. A process according to claim 1 characterised in that the pH value of the solution is 9.5 to 10.5.

9. A process according to claim 8 characterised in that the pH value of the solution is 9.8 to 10.3.

10. A process according to claim 1 characterised in that the desired pH of the solution is obtained by passing $CO_2$ or $SO_2$ through the solution.

11. A process according to any one of claim 1 characterised in that the desired pH of the solution is obtained by adding acids selected from the groups $HNO_3$, $H_3PO_4$, HF, $HBF_4$ and citric, salicylic, tartaric and benzoic acids.

12. A process according to claim 1 characterised in that the solution contains the anions $HCO_3^-$, $HPO_4^{---}$, $HPO_4^-$, $CO_3^{--}$, $PO_4^{---}$ and $OH^-$ and at least one cation selected from the group consisting of $Na^+$, $K^+$ and $NH_4^+$.

13. A process according to claim 1 carried out in a tank of electrically conducting material characterised in that the tank is made the cathode of the electrolyte treatment cell.

14. A process according to claim 1 characterised in that the operating voltage is 2 to 25 volts DC.

15. A process according to claim 14 characterised in that the operating voltage is 10–15 volts DC.

* * * * *